US005663520A

United States Patent [19]

Ladika et al.

[11] Patent Number: 5,663,520

[45] Date of Patent: Sep. 2, 1997

[54] VEHICLE MINE PROTECTION STRUCTURE

[75] Inventors: Michael D. Ladika, Loveland; Dennis Jerome Malone, Indian Springs, both of Ohio; David John Stevens, San Antonio, Tex.

[73] Assignee: O'Gara-Hess & Eisenhardt Armoring Co., Fairfield, Ohio

[21] Appl. No.: 658,239

[22] Filed: Jun. 4, 1996

[51] Int. Cl.[6] ..... F41A 27/00

[52] U.S. Cl. ..... 89/36.08; 89/36.09; 296/204

[58] Field of Search ..... 89/36.09, 36.08; 296/204

[56] References Cited

U.S. PATENT DOCUMENTS

| | | | |
|---|---|---|---|
| 787,065 | 4/1905 | White | 89/36.01 |
| 796,768 | 8/1905 | Steinmetz | 89/36.01 |
| 2,348,130 | 5/1944 | Hardy, Jr. | 89/36.01 |
| 2,382,862 | 8/1945 | Davis, Jr. | 89/36.09 |
| 2,389,579 | 11/1945 | Reynolds | 89/36.08 |
| 2,399,691 | 5/1946 | Partiot | 89/36.01 |
| 2,758,660 | 8/1956 | Bouffort | 89/36.08 |
| 3,575,786 | 4/1971 | Baker et al. | 89/36.01 |
| 3,699,842 | 10/1972 | Grewing et al. | 89/36.02 |
| 3,765,299 | 10/1973 | Pagano et al. | 89/36.02 |
| 4,061,815 | 12/1977 | Poole, Jr. | 89/36.02 |
| 4,111,097 | 9/1978 | Lasker | 89/36.02 |
| 4,131,053 | 12/1978 | Ferguson | 89/36.02 |
| 4,186,648 | 2/1980 | Clausen et al. | 89/36.02 |
| 4,198,454 | 4/1980 | Norton | 89/36.01 |
| 4,323,000 | 4/1982 | Dennis et al. | 89/36.08 |
| 4,326,445 | 4/1982 | Bemiss | 89/36.08 |
| 4,398,446 | 8/1983 | Pagano et al. | 89/36.08 |
| 4,404,889 | 9/1983 | Miguel | 89/36.08 |
| 4,529,640 | 7/1985 | Brown et al. | 89/36.02 |
| 4,566,237 | 1/1986 | Turner | 89/36.02 |
| 4,716,810 | 1/1988 | DeGuvera | 89/36.02 |
| 4,727,789 | 3/1988 | Katsanis et al. | 89/36.02 |
| 4,841,838 | 6/1989 | Scully et al. | 84/36.02 |
| 4,965,138 | 10/1990 | Gonzalez | 89/36.02 |
| 5,059,467 | 10/1991 | Berkovitz | 89/36.02 |
| 5,179,244 | 1/1993 | Zufle | 89/36.02 |
| 5,314,230 | 5/1994 | Hutchison et al. | 296/203 |
| 5,435,226 | 7/1995 | McQuilkin | 89/36.02 |
| 5,448,938 | 9/1995 | Fernandez et al. | 89/36.08 |
| 5,533,781 | 7/1996 | Williams | 296/204 |

FOREIGN PATENT DOCUMENTS

| | | |
|---|---|---|
| 2706997 | 3/1975 | France . |
| 3627485 | 2/1988 | Germany . |
| 4136699 | 9/1990 | Japan . |

*Primary Examiner*—J. Woodrow Eldred

*Attorney, Agent, or Firm*—Wood, Herron & Evans, L.L.P.

[57] ABSTRACT

A system for protecting a passenger compartment of a vehicle from forces arising from a mine activated by a wheel. The system (28) includes an underbody protective plate structure (46) covering areas of a forward portion of the passenger compartment in which the lower legs and feet of an occupant are located. The system (28) further includes a shield structure (44) fabricated on the protective plate structure (46) in front of lower-forward walls (36,38) of the forward portion (32). In addition, reinforcing plates (48,50) extend adjacent the side walls of the forward portion (32) and are connected to the protective plate structure (46).

37 Claims, 7 Drawing Sheets

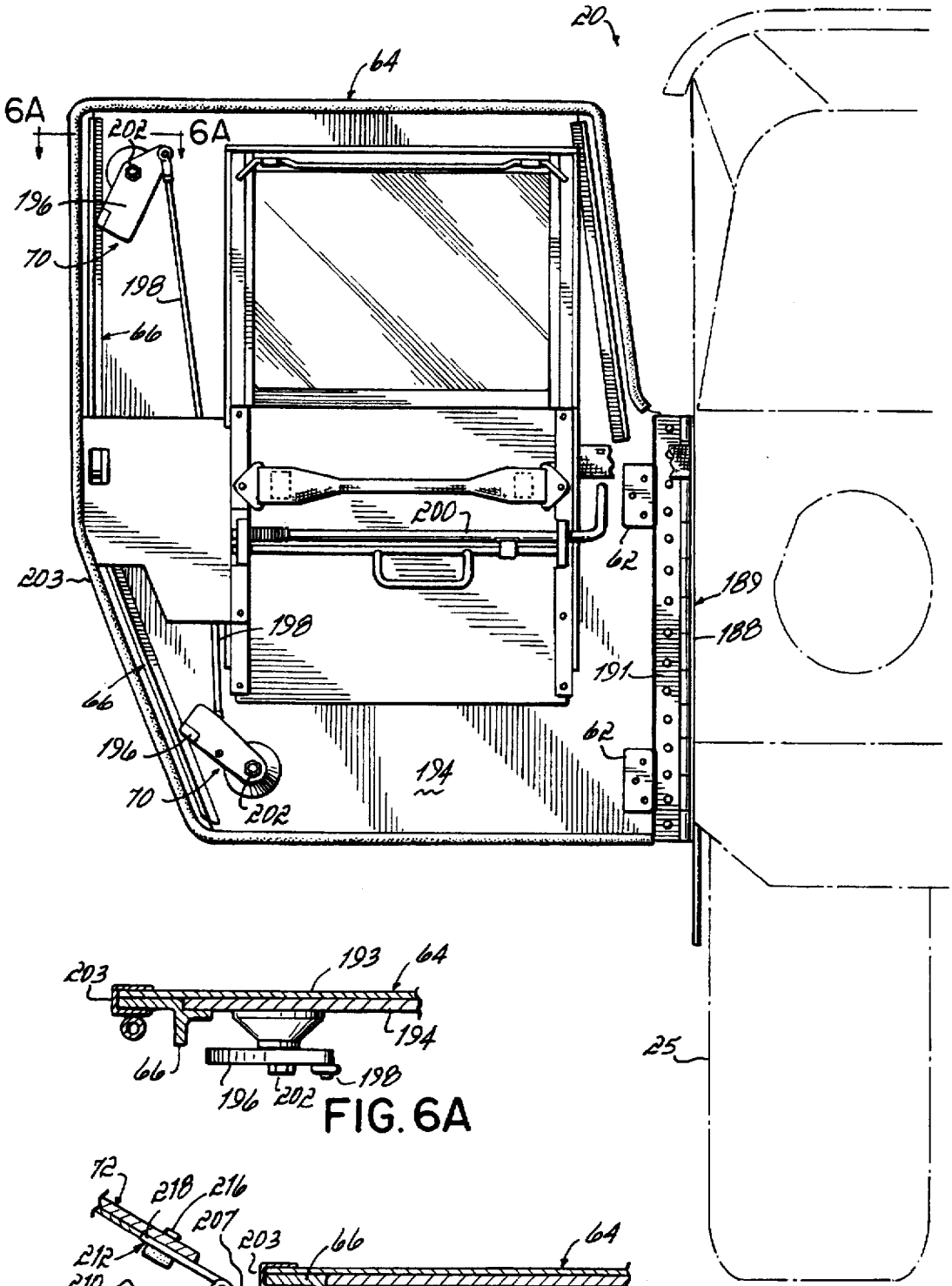
FIG. 6
FIG. 6A
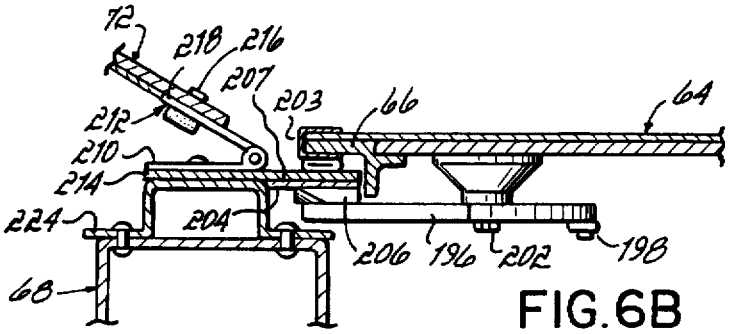
FIG. 6B

VEHICLE MINE PROTECTION STRUCTURE

FIELD OF THE INVENTION

This invention relates generally to armoring, and more particularly to an armoring system for a military land vehicles and other types of vehicles and structures.

BACKGROUND OF THE INVENTION

Military operations require many different types of land vehicles. One type of military land vehicle is a high speed, high mobility, reconnaissance vehicle, for example, a High Mobility Multipurpose Wheeled Vehicle ("HMMWV"). All types of military land vehicles may encounter many, and at least three types, of explosives: (1) anti-tank mines, (2) anti-personnel mines and (3) claymores. In the case of these types of destructive devices, these devices may be detonated by the pressure of one or more of the tires or wheels of the vehicle rolling over them, or by remote detonation. The anti-tank and anti-personnel mines generally rely on pure blast pressure for destructive incapacitive effect. The claymores, on the other hand, have a lower blast pressure than that characteristic of the anti-tank mines. The claymores rely primarily on hundreds of flying shrapnel fragments for incapacitation effect. Thus, the underbody of military land vehicles should be constructed to withstand and/or deflect both pure blast pressure and flying shrapnel fragments to minimize damage to and deformation of the passenger compartment of the vehicle and thereby minimize the potential for injury to the vehicle occupants. Many models of a HMMWV are manufactured on an automotive type of chassis and do not, as manufactured, have the armor or structure to protect occupants of the HMMWV from mine blasts. Consequently, several armoring systems have been developed for an unarmored HMMWV.

One prior system for armoring the underbody of a HMMWV is shown in U.S. Pat. No. 4,326,445. In that patent, a plurality of armor protection plates attached to the underbody protect the frame members underneath of the vehicle from upwardly directed projectiles. Another prior system is described in U.S. patent application Ser. No. 08/262,768 for Armoring Assembly, filed Jun. 20, 1994 and assigned to the assignee of the present application. The described HMMWV armoring system is a blast pressure and shrapnel fragment defeating structure comprised of a fibrous material secured preferably to the upper surface of the floor area. In addition, a ballistic panel/blast shield is disposed below the floor and spaced therefrom so as to form an air gap therebetween. The above prior systems have improved the protection of personnel in the vehicle from the blast pressure and shrapnel. However, there is a continuing desire to provide even better armoring techniques and systems for protecting the passenger compartment of a vehicle against the blast pressures and shrapnel of larger mines, for example, anti-tank mines of 12 lbs. and above.

SUMMARY OF THE INVENTION

It is, therefore, an object of the present invention to provide a system for protecting the passenger compartment of a military land vehicle against the blast forces and shrapnel fragments associated with smaller mines as well as larger mines of twelve pounds or more.

To overcome the disadvantages of the prior systems, the present invention provides an improved system to protect a passenger compartment of a vehicle from the forces and shrapnel of an exploding mine. The passenger compartment has a forward compartment in which the legs and feet of an occupant are located. The forward compartment is generally located ahead of a pillar to which the front door is hinged. The system includes a protective plate structure shaped to cover areas of the forward compartment. The system includes reinforcing liners or plates located adjacent side walls of the forward compartment and connected to the protective plate structure. In addition, the protective plate structure includes a shield that is connected to the reinforcing plates and located between an anticipated source of the blast and the lower legs and feet of an occupant. The invention has the advantage of redirecting and transferring the forces resulting from the mine explosion around the forward compartment to the stronger, more rigid structural elements of the vehicle.

In one aspect of the invention, the shield has a shield plate spaced away from a lower-forward section of the protective plate structure. The shield further includes a plurality of reinforcing elements arranged in a spaced apart relationship between the shield plate and the lower-forward section of the protective plate structure. Preferably, the reinforcing elements are hollow and extend in a parallel relationship between the lateral edges of the shield plate and the lower-forward section of the protective plate structure.

In another embodiment of the invention, the protective system includes first and second abutments that are mounted on and extend adjacent the forward and rear edges respectively of a front door of the vehicle. The first abutment is located to be in juxtaposition with the rear edge of the pillar to which the front door is mounted. The second abutment is mounted to be in juxtaposition with a forward edge of a second pillar against which the door closes. The door further includes a manually operable pivoting latch that is movable between first and second positions. In the first position, the latch permits the door to open. With the door closed, moving the latch to the second position extends the latch over a surface of the second pillar to prevent the door from opening in response to the blast forces. The above construction is effective to transfer blast forces received by the first pillar to the first abutment across the front door to the second abutment and into the second pillar, thereby further transferring forces rearwardly along the vehicle and around the passenger compartment. In a further aspect of the invention, the above construction of abutments and latch is also applied to the rear doors of the vehicle.

These and other objects and advantages of the present invention will become more readily apparent during the following detailed description taken in conjunction with the drawings herein, in which:

BRIEF DESCRIPTION OF THE DRAWINGS

FIG. 6 is a side elevation of a left front door illustrating the abutments and latches in accordance with the principles of the present invention.

FIG. 6A is a cross-sectional view taken along line 6A—6A of FIG. 6 showing the door in an open position and the latch in an unclosed position.

FIG. 6B is a view similar to FIG. 6A illustrating the latch of FIG. 6A in the closed position.

DETAILED DESCRIPTION OF THE INVENTION

Figure 1:
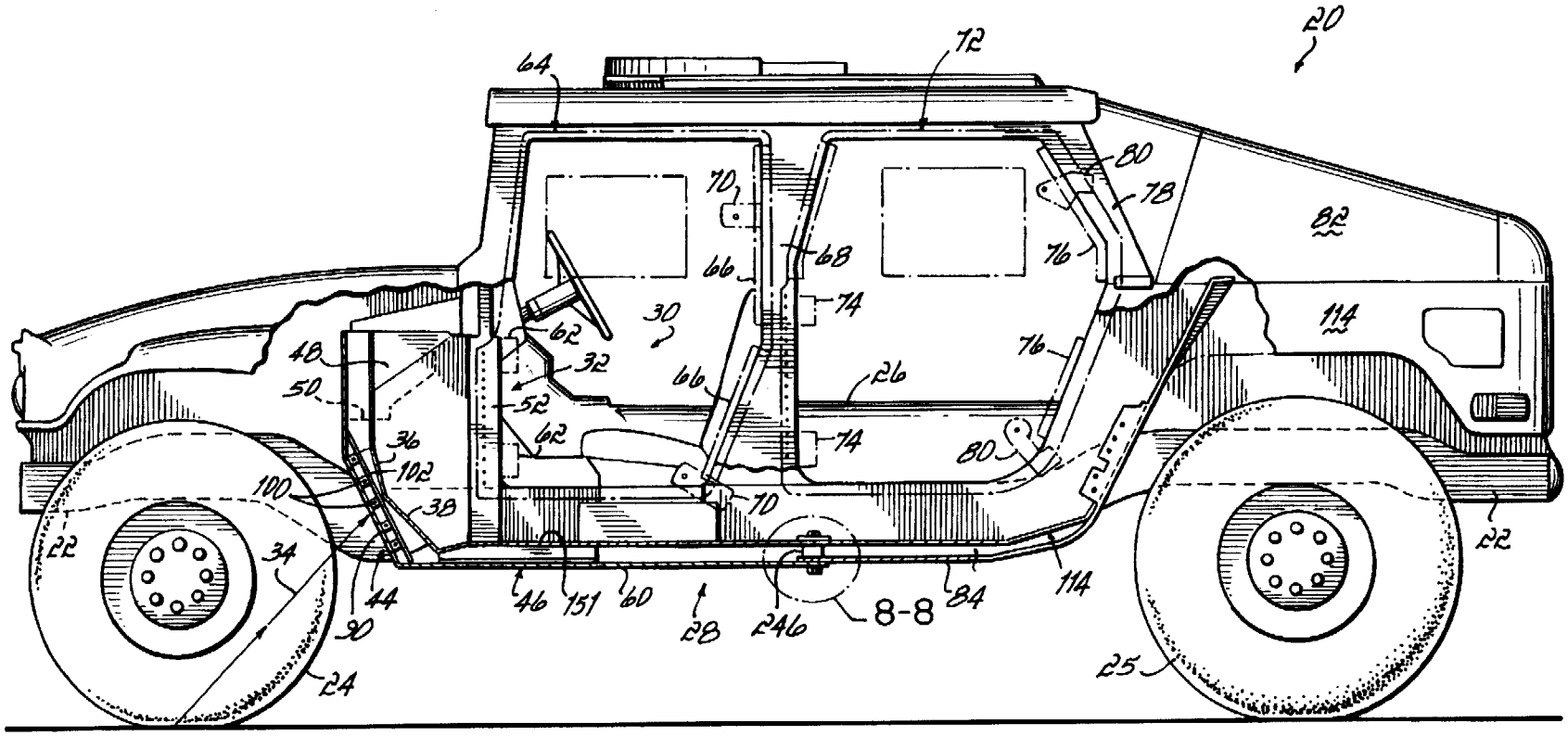
FIG. 1 is a side elevation view of a HMMWV employing an armor system in accordance with the principles of the present invention.
Figure 2:
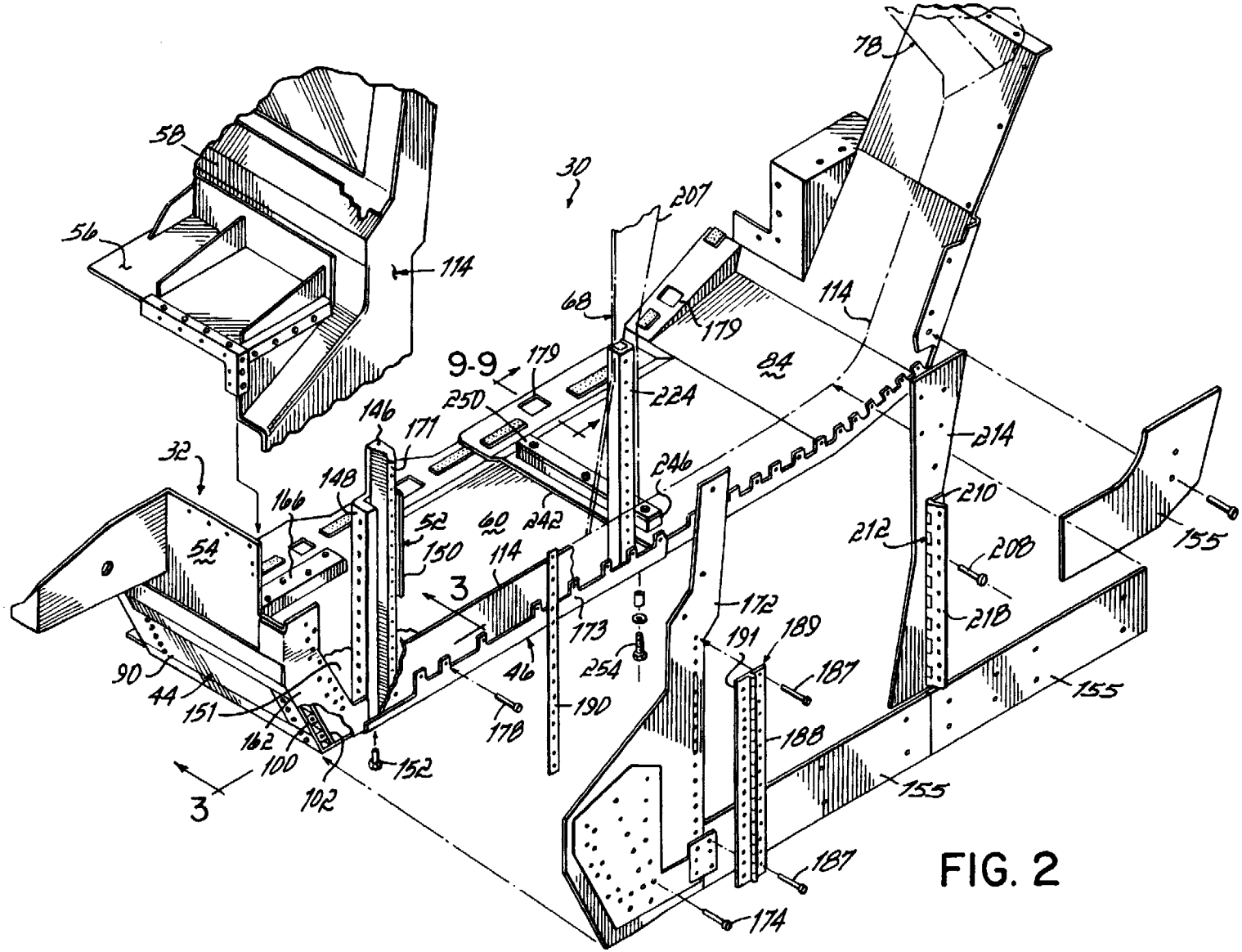
FIG. 2 is a disassembled perspective view of components of the armor system.

Referring to FIG. 1, one model of a HMMWV 20 often used by the military is illustrated. The vehicle has a chassis, including longitudinal frame rails 22 that extend substantially the full length of the vehicle. In a known manner, the engine drive train and suspension (not shown), including the wheels 24, are mounted to the chassis. A central tunnel structure 26 extends longitudinally in the central portion of the vehicle between the frame rails 22. A protective system 28 shown in a disassembled perspective in FIG. 2 is designed to protect occupants in the passenger compartment 30 from the forces of a mine blast that is triggered or detonated by one of the pair of front wheels 24 or the pair of rear wheels 25. The system 28 illustrated in FIGS. 1–6, 8 is applied to the left side of the body structure of the vehicle 20. As will be appreciated, the right side body structure of the vehicle 20 is almost an identical mirror image of the left side body structure. Therefore, in the preferred embodiment of the invention, the protective system 28 as is described and illustrated with respect to the body structure on the left hand side of the vehicle is also applied to the body structure of the right hand side of the vehicle. The discussion to follow assumes that the left front wheel 24 detonates the mine. In that event, a forward portion of the passenger compartment 30, for example, forward compartment 32, is most at risk. The blast forces inflicting the greatest damage are those forces 34 that are normal to or substantially perpendicular to the vehicle surfaces, for example, the lower-forward surfaces 36, 38 of the forward portion 32 of the passenger compartment 30. Those lower-forward surfaces 36, 38, absent any protection, will normally experience substantial deformation from a mine blast detonated by the left front wheel 24. Further, the occupant of the passenger compartment 30 is exposed to the risk of severe injuries to the lower legs and feet, spinal injuries, excessive and potentially fatal cabin pressure increases and general trauma. Consequently, a mine blast from smaller mines may cause serious injury or death to the occupant; and for larger mines, for example, mines of 12 lbs. explosive weight or above, the blast is often fatal.

As the angle of incidence of the blast forces decreases with respect to the incident surface, the component of the blast force which is perpendicular to the incident surface becomes smaller; and in turn, the incident surface experiences less damage. Therefore, blast forces which are oblique to the vehicle surfaces they impact, are more readily deflected by those surfaces and are less likely to cause severe damage to the vehicle.

The protective system 28 is designed to absorb some of the blast forces impacting the forward portion 32 of the passenger compartment 30; however, the system 28 must minimize deformation of the lower-forward surfaces 36, 38 so as to minimize injury to the lower legs and feet of the occupant. Therefore, the system 28 functions to transfer the blast forces 34 around the boundaries, or periphery of the forward portion 32 and into the more rigid structural members of the vehicle 20.

Figure 4:
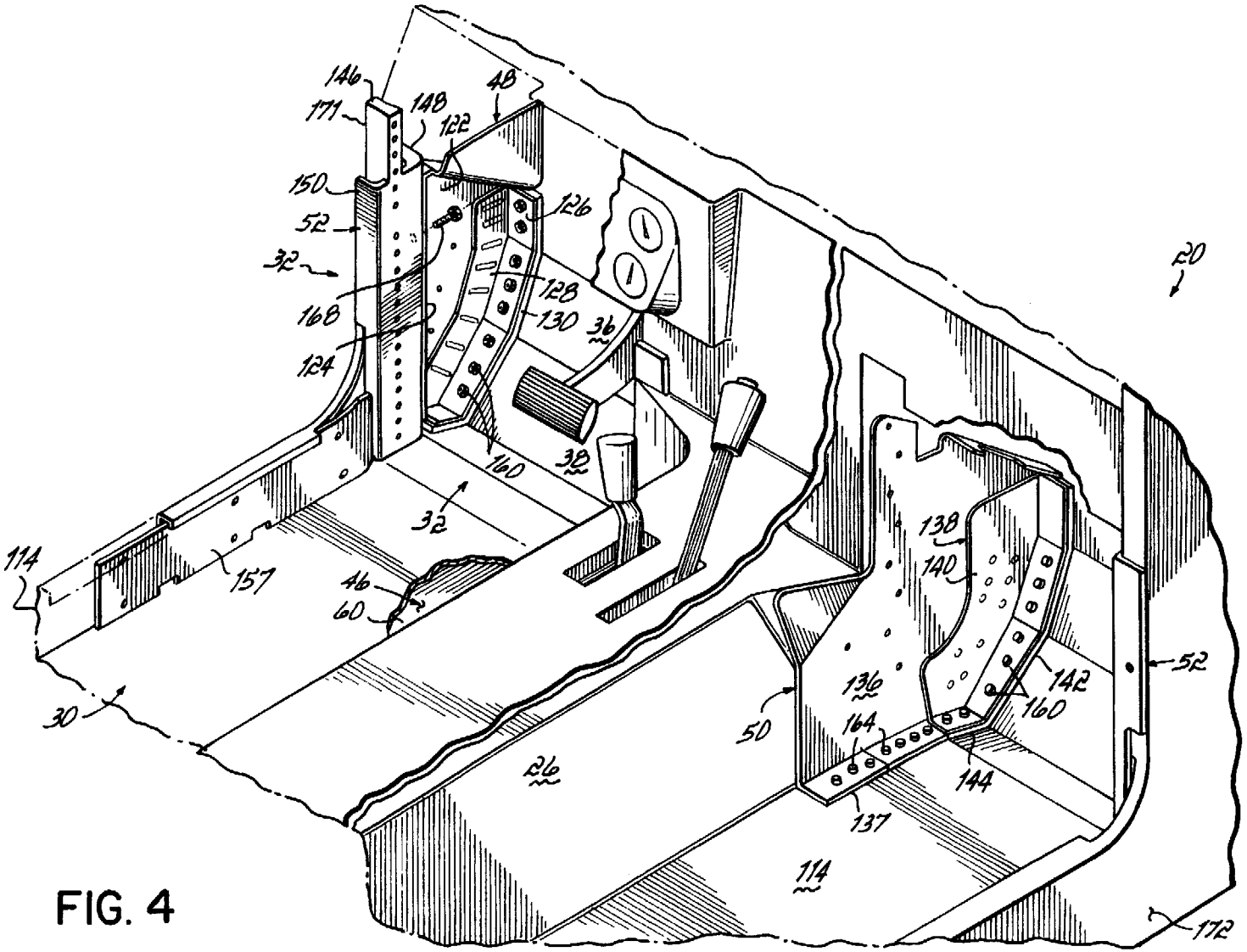
FIG. 4 is a partial perspective view illustrating reinforcing liners used on the interior of the vehicle of FIG. 1.
Figure 5:
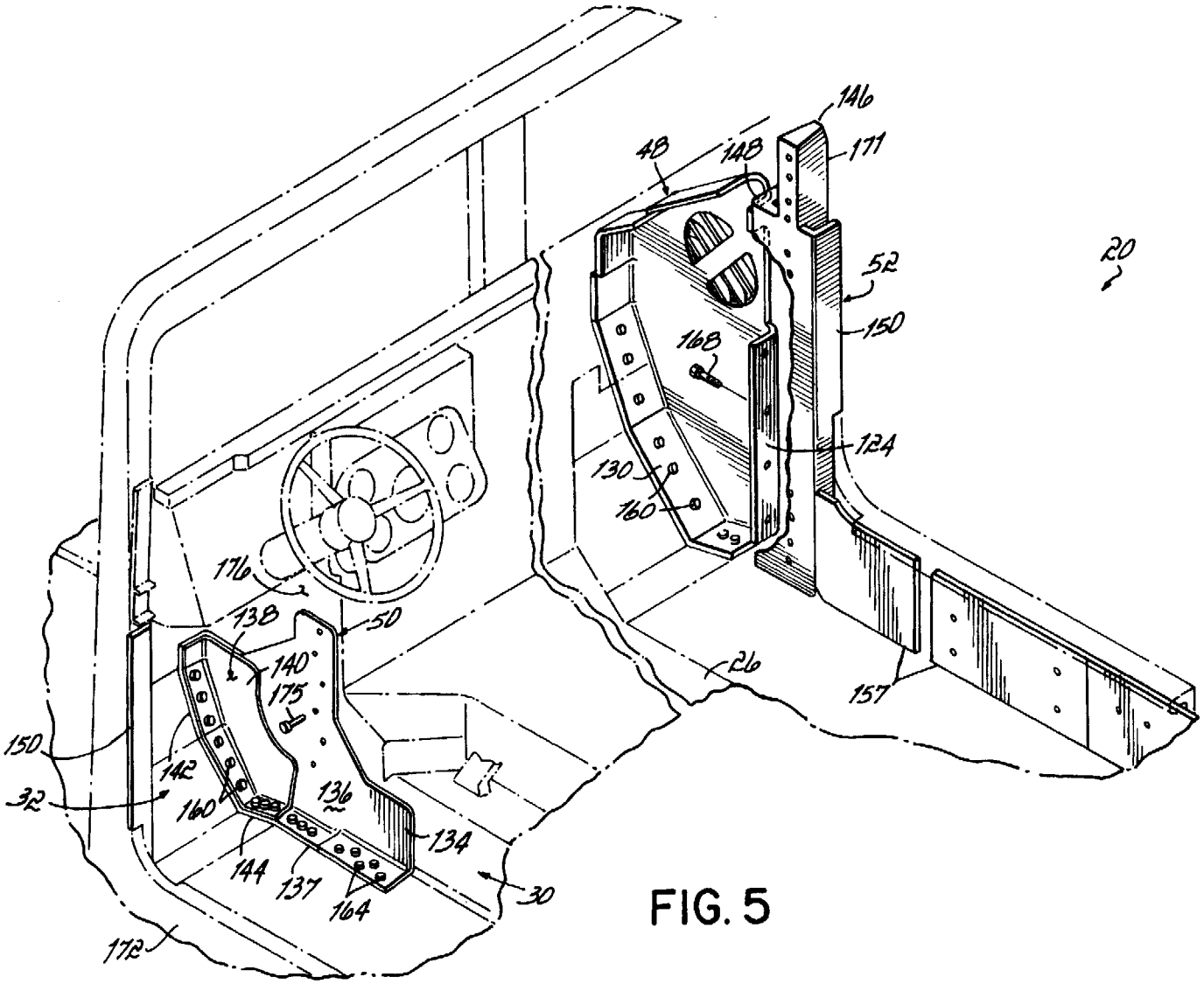
FIG. 5 is a partial perspective view illustrating other reinforcing liners used on the interior of the vehicle of FIG. 1.

The most potentially damaging of the blast forces 34 are received by a shield structure 44 integrated on a forward underbody protective plate structure 46. The shield structure 44 is designed to experience minimal deflection and deformation to minimize the deformation of the lower-front walls 36, 38 of the forward portion 32. The major function of the shield 44 is to transfer the blast forces 34 through the walls surrounding the forward portion 32 and into other structural members of the vehicle 20. The shield 44 transfers blast forces from its lateral edges into outer and inner reinforcing liners or plates 48, 50, respectively, (FIGS. 4 and 5). The outer reinforcing plate 48 transfers the blast forces it receives from the shield 44 into a forward column or upright reinforcement 52 associated with what is generally known as the A-pillar of the vehicle 20. The blast forces are also transferred from an upper edge of the shield 44 through a protective plate 54 and an upper or interconnecting plate 56, which are rigidly attached together and between the upper edge of the shield 46 and a rigid cross member of the vehicle shown generally at 58. A lower protective plate 60 transfers blast forces from a lower edge of the shield 44 to the vehicle body structure to which the lower protective plate 60 is bolted. The part of the system 28 thus far described is highly effective at routing and transferring the blast forces 34 through the shield 44 and around the forward portion 32 of the passenger compartment 30. Consequently, the shield 44 experiences minimal deformation and protects the lower-forward surfaces 36, 38 which are in a direct line with the most destructive of the blast forces.

Therefore, in its preferred embodiment, the protective system 28 effectively redistributes the forces resulting from the exploding mine and received by the shield structure 44 away from the lower-forward surfaces 36, 38 of the forward portion 32 to the more rigid vehicle structural members, for example, the pillars 52, 68, 78. The system 28 of the preferred embodiment is highly effective at minimizing deformation of the forward portion 32 of the passenger compartment 30 and, in addition, protects the passenger compartment 30 from the blast forces.

The performance of the protective system 28 can be further improved by transferring blast forces from the A-pillar reinforcement 52 to a first abutment 62, rigidly mounted on the inner side of a front door 64, shown in phantom in FIG. 1. The first abutment 62 is mounted adjacent the forward edge of the door 64 and in juxtaposition with a rearward edge of the A-pillar reinforcement 52. The front door 64 transfers the blast forces to a second abutment 66 mounted on the inner surface adjacent its rearward edge and is in immediate juxtaposition with a second reinforced column or upright which is generally known as the B-pillar 68. During the mine explosion, the abutments 62, 66 on the door 64 transfer the blast forces from the A-pillar reinforcement 52, across the door 64 and into the B-pillar 68. That transfer of forces is facilitated by the use of auxiliary, heavy duty latches 70 which secure the front door 64 in its closed position during the blast.

In a further aspect of the invention, to further improve the distribution of blast forces through the vehicle structure, the rear door 72, shown in phantom in FIG. 1, has a first abutment 74 mounted on an inner surface and adjacent its forward edge in juxtaposition with a rearward edge of the B-pillar 68. In addition, a second abutment 76 is mounted on the inner surface and adjacent the rearward edge of the rear door 72 in juxtaposition with a rear or C-pillar 78. As with the front door 64, heavy duty latches 80 are used to prevent the rear door 72 from opening during the blast. Consequently, the rear door 72 functions to transfer blast forces from the B-pillar 68, across the rear door 72, to the C-pillar 78 and into the rear structure 82 of the vehicle 20. Therefore, in this embodiment of the invention, the system 28 effectively redistributes the blast forces from the A-pillar reinforcement 52 across the front door 64 to the B-pillar 68 across the rear door 72 and into the rear structure of the vehicle 82.

To further distribute the forces throughout the vehicle structure, the protective system 28 includes a rear underbody protective plate structure 84, which is bolted to the forward underbody protective plate structure 46, as well as the vehicle structure located behind the B-pillar 68. in this further embodiment, the protective system 28 effectively transfers the blast forces along the lower structure of the vehicle. The result of the use of the entire protective system 28 is to distribute the blast forces through the side and bottom portions of the vehicle structure that surrounds the passenger compartment 30, thereby protecting the occupants in the passenger compartment 30 from the blast forces.

The most important part of the protective system 28, that is, the portion of the system 28 that maintains the integrity of and, minimizes damage to, the forward portion 32 of the passenger compartment 30 includes the forward underbody protective plate structure 46, the shield structure 44, the outer plate 48 and the inner plate 50. In order to minimize deflection and damage to the lower-forward surfaces 36, 38 of the forward portion 32, the shield structure 44 is fabricated on a lower-forward section of the protective plate structure as shown in to FIG. 3. The shield structure 44 includes a lower-forward section of plate 90 of the plate structure 46. The protective plate 90 is located between a bottom protective plate 60 and a forward protective plate 94. The plates 60, 90, 94 are preferably made from a high hardness, wrought, steel armor plate approximately 0.140 inches thick per MIL-A-46177 and together form an underbody base plate 96 portion of the forward underbody protective plate structure 46. The shield 44 further includes a plurality of reinforcing elements, preferably, structural steel tubes 100 and an inner reinforcing shield plate 102 that preferably, are rigidly connected to the armor plate 90. Preferably, the tubes are welded to an upper surface of the plate section 90 and a lower surface of the shield plate 102. The tubes extend substantially over the full width of the plate section 90 and are preferably oriented to be parallel with each other to permit a desired minimal deformation of the shield structure 44 in response to the blast forces. Preferably, the shield assembly 44 is fabricated to form a beam structure that in response to the blast forces, places a side closer to the blast in compression and an opposite side in tension. The tubes 100 are preferably manufactured from a structural steel tube of a ASTM A500 GR B material having a wall thickness of approximately 0.125 inches. The plate 102 is preferably positioned parallel to plate 90 and is welded to the tubes 100, the bottom plate 60 and forward plate 94. The plate 102 is preferably made of 4130 RC 39-42 steel approximately 0.100 inches thick. Upper and lower reinforcing spacers or wedges 104, 106, respectively, are U-shaped channels and are welded at the lateral edges of the plate 102 and function to space the plate 102 from the wall sections 36, 38. The reinforcing wedges 104, 106 have respective upper sides 108, 110 that are shaped to provide a bearing surface against the forward surface 112 of the sheet metal body structure 114 of the vehicle 20. The reinforcing spacers are preferably made of ASTM A500 GR B structural steel tube having a wall thickness of approximately 0.250 inches. The shield structure 44 may also include other reinforcing structure, for example, an angle strip 116 that extends laterally across the intersection of the plates 60 and 102 and is welded to the plates 60, 102 to provide additional rigidity.

Referring to FIG. 4, the left side reinforcing plate 48 includes a side plate 122 having a mounting flange 124 extending over the rearward edge of the plate 122. A reinforcing element 126 has a side plate 128 welded to the side plate 122. The reinforcing element 126 also includes a mounting flange 130. The left side reinforcing plate 48 is preferably made from aluminum 5083 H321. The primary liner element 122 is preferably 0.375 inches thick, and the element 126 is approximately 0.250 inches thick.

FIG. 5 illustrates the left side inner reinforcing plate 50. The reinforcing plate 50 includes a side reinforcing plate 134 having a gusset 136 and a lower mounting flange 137. A reinforcing element 138 has a side plate 140 that is welded to the side plate 134. The reinforcing element 136 further includes a mounting flange 142 extending along the forward edge of element 136, and a second mounting flange 144 extending along the lower edge of reinforcing element 136. The left side inner reinforcing plate 50 is preferably made of the same material as the reinforcing plate 48.

Referring to FIG. 2, the A-pillar reinforcement 52 is illustrated in more detail and includes a unitary structure having a center body column or upright 146, an L-shaped forward column 148 extending along a forward edge of center column 146 and an L-shaped rear column 150 extending along a rear edge of center column 146. The A-pillar reinforcement 52 is mounted on an upper surface of a bottom section 151 of the vehicle body 114 by fasteners 152. The A-pillar reinforcement 52 is preferably made of aluminum 6061-T6 extrusion that meets 6061-T6 to a depth of 0.500 inches and must meet at least a 6061-T5 at depths greater than 0.500 inches.

Figure 3:
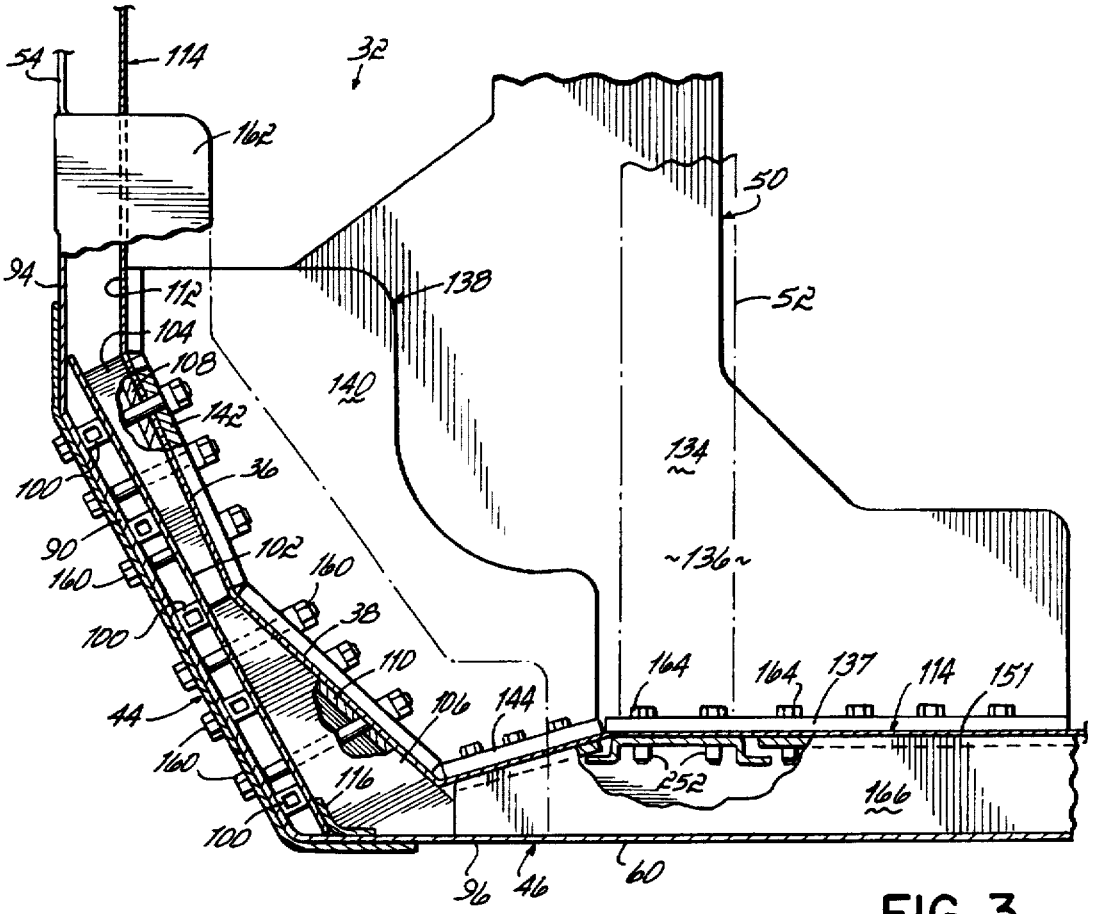
FIG. 3 is a cross-sectional view taken along line 3—3 of FIG. 2.

To provide the necessary protection for the passenger compartment 30, the above described elements, including the forward underbody structure 46 with its integral shield 44, the outer reinforcing plate 48, the inner reinforcing plate 50, and the A-pillar reinforcement 52 are connected to the body structure 114 of the vehicle 20 such that those components with the body 114 form an integral unitary structure. For example, referring to FIGS. 3 and 4, fasteners, such as nuts and bolts 160 extend through an outer corner flange 162, the plate 90, reinforcing plate 102, the flanges 108, 110 of respective reinforcing wedges 104, 106, through the vehicle body 114, and through the mounting flange 130, which abuts against an inner surface of the body 114 and is an integral part of the outer reinforcing plate 48. The reinforcing wedges 104, 106 illustrated in FIG. 3 are located along the outer lateral edge of the shield structure 44. There are corresponding reinforcing wedges along the inner lateral edge of the shield structure Further, as illustrated in FIG. 5, there are corresponding fasteners 160 along the inner lateral edge of the shield structure that extend through the mounting flange 142 of the inner reinforcing plate 50, the vehicle structure 114, flanges of reinforcing wedges that are similar to the flanges 108, 110 of wedges 104, 106, reinforcing plate 102, and plate 90. Therefore, the fasteners 160 are effective to fasten the above elements together to form a unitary rigid structure. Referring to FIGS. 2, 3, and 5, fasteners, such as nuts and bolts 164 extend through the lower flange 137 of the inner reinforcing plate 50, the vehicle body 114 and the channel 166 of the forward underbody structure 46.

As shown in FIGS. 2 and 4, the rear side of the outer reinforcing plate 48 is also rigidly connected to the forward column 148 of the A-pillar reinforcement 52 by bolts or other fasteners 168 that extend through the rear mounting flange 124 of the outer reinforcing plate 48 and are threaded into the forward column 148.

Referring to FIG. 2, the left side of the vehicle structure 114 of the forward portion 32 extends over the outer surface 171 of the center column 146 of the A-pillar reinforcement 52. A left side wall armor or protective plate 172 is mounted over the left side vehicle structure 114 and inside the corner flange 162. A first plurality of fasteners 174 extend through the corner flange 162, through the side wall plate 172, through the left side of vehicle structure 114 and through the side plate 122 (FIG. 4) of the outer reinforcing plate 48. Another group of fasteners 174 extend through the plate 172, the left side vehicle structure 114, and the side plate 122 (FIG. 4) of the outer reinforcing plate 48. The interconnection of the plate 172 left side vehicle structure 114 and side plate 122 provides a very rigid construction for the side wall of the forward portion 32.

Referring to FIG. 5, fasteners such as threaded bolts 175 extend through the side plate 134 of the inner reinforcing plate 50 and through a side wall of the tunnel 26. That connection increases the rigidity of the inner side wall 176 of the forward portion 32. Referring to FIG. 2, the forward underbody protective plate structure 46 contains an outer side flange 173. Fasteners 178, for example, nuts and bolts, extend through holes in flange 173 through the left side vehicle structure 114 to rigidly connect the outer lateral edge of the forward underbody plate structure 46 to the vehicle 20. The inner lateral edges of the forward and rear underbody plate structures 46, 84 contain openings 179. Referring to FIGS. 2, 4 and 5, a lower portion of the vehicle body structure 114 is protected and made more rigid by fastening it between outer protective plates 155, preferably of steel and inner metal liners 157.

Figure 9:
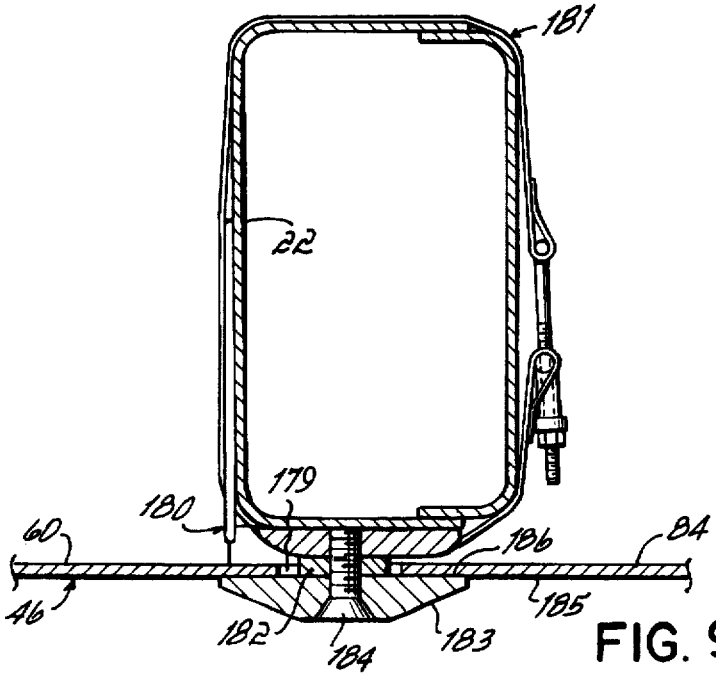
FIG. 9 is a cross-sectional view taken along line 9—9 of FIG. 2.

Referring to FIG. 9, adjacent each of the openings 179, a bracket 180 is attached to the frame rail 22 using band straps 181 or alternatively, adhesive, rivets or other fasteners. The bracket 180 has a boss 182 extending from its lower surface and into the opening 179. The boss 182 is shaped to that there is a clearance or space between the outer periphery of the boss and the periphery of the opening 179. A retainer 183 is connected to the lower side of the boss with a screw or other fastener 184. With this construction, the lower surface 185 of the respective front and rear underbody structure 46, 84 is carried on the upper surface 186 of the retainer 183. Thus, the inner lateral edges of the forward and rear underbody plate structures 46, 84 are suspended from and able to move with respect to the frame rails during the normal operation of the vehicle 20. The suspended mounting helps to prevent excessive stresses and forces from being applied to the frame rails 22.

The above described construction and interconnection of the shield structure 44 and forward underbody plate structure 46, outer reinforcing plate 48, inner reinforcing plate 50 and A-pillar reinforcement 52 provides a rigid unitary structure with the existing vehicle body to minimize damage and deformation to the forward portion 32 of the passenger compartment 30. The shield structure 44 is primarily effective to transfer the blast forces to its periphery and upwardly and rearwardly through the vehicle structure. The forces along the lateral edges are transferred across the reinforcing wedges 104, 106 through the vehicle body sections 36, 38 across the internal outer and inner reinforcing plates 48, 50, respectively and to either the central tunnel structure 26 or the A-pillar reinforcement 52. Forces along the upper edge of the shield structure 44 are transferred through plates 54, 56 into cross member 58, which is also interconnected with the A-pillar reinforcement 52. The blast forces along the lower edge of the shield structure 44 are transferred through the base plate 96 and into the lower structure of the vehicle.

While the structure thus far described is effective at transferring blast forces around the forward portion 32 into portions of the vehicle structure, in accordance with a further embodiment of the invention, the blast forces can be further distributed to other structures of the vehicle. For example, referring to FIG. 2, fasteners 187 are used to fasten one section 188 of a door hinge 189 to the A-pillar reinforcement 52. The fasteners extend through the hinge section 188, the plate 172, a spacer 190, the left side vehicle structure 114 and through the center body 146 of the A-pillar reinforcement 52. The other hinge section 191 is bolted on to the edge of the front door 64 as illustrated in FIG. 6. The door 64 includes first abutment blocks 62 that are bolted or welded to an interior surface of the door 62 along its forward edge. As shown in FIG. 1, when the door is closed, the blocks 62 are located immediately adjacent the L-shaped rear column 150 of the A-pillar reinforcement 52. Consequently, as the forces of the blast are transferred rearwardly and upwardly around the forward portion 32 and into the A-pillar reinforcement 52 and plate 172, the rear edge of plate 172 is pushed into contact with the forward blocks 62, thereby transferring a portion of the blast forces to the forward abutment blocks 62.

As shown in FIG. 6A, the door 64 is normally constructed of an outer protective plate, for example, armor plate, 193 and a composite liner 194 that overlays and is connected to an inner surface of the protective plate 193. Second abutment angle blocks 66 in the form of an aluminum extrusion are mounted on the inner surface near the rearward edge of the protective plate 193 of the front door 64. In addition to providing a seal along the edge of the door, the angle blocks 66 function as force transfer blocks. When the front door 64 is closed, the protective plate extends over and overlays the B-pillar 68 and the angle blocks 66 are located immediately adjacent the B-pillar 68. Consequently, the protective system 28 uses the front door 64 to transfer blast forces from the A-pillar reinforcement 62 and plate 172 to the forward blocks 62, across the door 64 to the second abutment angle blocks 66 and to the B-pillar 68. Transferring the blast forces around the side walls of the passenger compartment 30 and rearwardly along the vehicle further preserves the mechanical integrity of the passenger compartment 30 and further reduces the risk of injury to the occupants of the passenger compartment.

In order to effectively transfer the blast forces across the door 64, it is necessary for the door 64 to remain in the closed position. Therefore, the door 64 is provided with an auxiliary mechanical latch 70. The latch 70 includes two pivoting latch arms 196, which are pivotally mounted at upper and lower locations adjacent the rear edge of the door 64. The latch arms 196 are coupled to connecting rods 198, which, in turn, are operatively connected to an operating handle 200. Lifting the handle 200 moves the connecting links 198 generally downward, thereby pivoting the latch arms 196 about pivot pins 202. As shown in FIG. 6B, each of the latch arms 196 pivots out beyond the rear edge 203 of the door 64 and extend behind an inner surface 204 of a respective latch block 206 of the B-pillar 68. The latch blocks 206 are welded or otherwise rigidly connected to a metal liner 207 of the B-pillar 68. Moving the latch arm 196 behind the latch block 206 of the B-pillar positively stops and blocks the front door 64 from opening during the blast.

Figure 7:
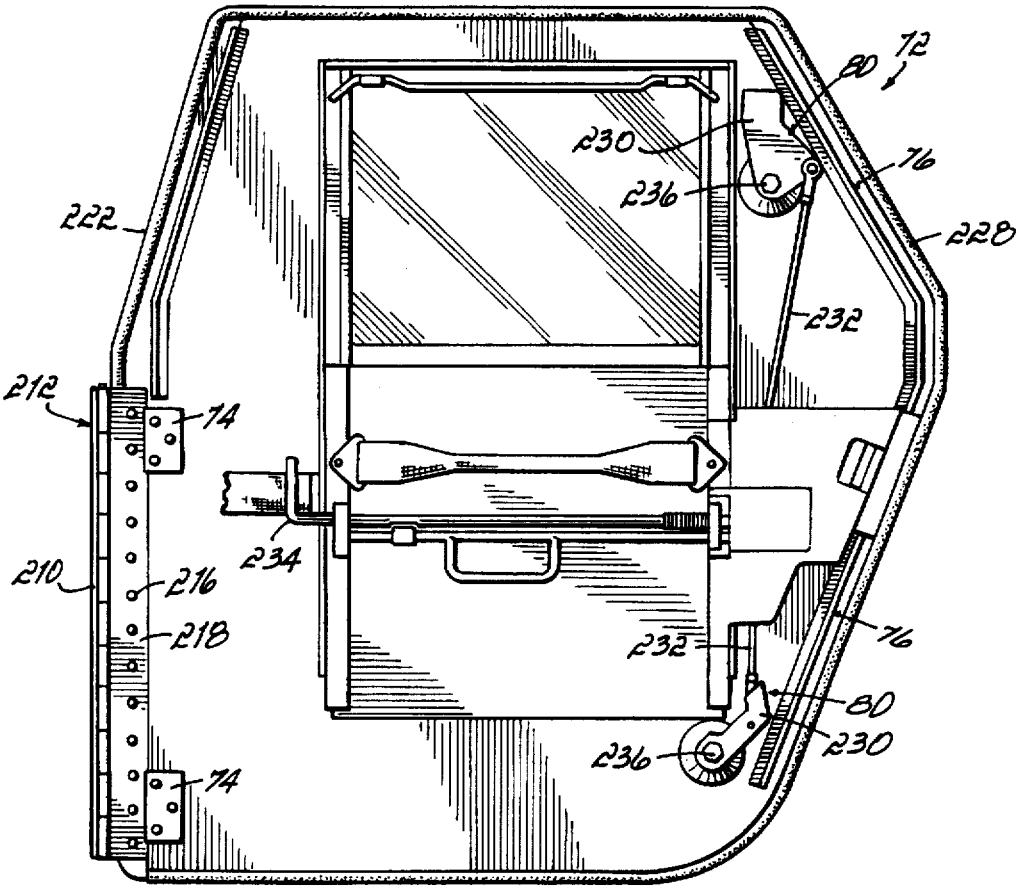
FIG. 7 is a side elevation of a right rear door illustrating the abutments and latches in accordance with the principles of the present invention.

As shown in FIG. 2, fasteners 208 extend through one side 210 of hinge 212, through the outer protective plate 214, and through a reinforcement channel 224 of the B-pillar 68. Referring to FIG. 7, fasteners 216 are used to connect the other side 218 of the hinge 212 to the forward edge of the rear door 72. The rear door 72 is preferably constructed in a known manner similar to the front door 64 with an outer protective or armor plate connected to an inner composite liner. The protective system 28 uses the rear door to facilitate the transfer of the blast forces from the B-pillar 68 to the C-pillar 78 (FIG. 1) of the vehicle 20. The forward abutment blocks 74 on the rear door 72 are located in a spaced apart relationship along the forward edge 222 of the rear door 72. The blocks 74 are positioned to be immediately adjacent the rearward edge of the B-pillar 68 when the door 72 is closed. The rear abutment angle blocks 76 on the door 72 are comparable in shape to the angle blocks 66 on the front door 64. The angle blocks 76 are mounted in the inner surface and along the rear edge 228 of the protective plate of the door 72. The angle blocks 76 have an outwardly extending flange that is positioned to be adjacent the C-pillar 81. The C-pillar 81 is constructed of a protective outer plate and an inner metal liner in the same manner as described with respect to the B-pillar 68. The rear door 72 illustrated in FIG. 7 is a right side rear door, and the construction and latches on the left side rear door 72 of FIG. 1 is comparable.

As with the front door, it is necessary that the rear door 72 remain closed during the blast. Therefore, an auxiliary latch system 80 is comprised of two latch arms 230 pivotally mounted adjacent the rear edge 228 of the door 72. Connecting links 232 operatively connect the latch arms 230 to an operating handle 234. Moving the handle 234 in a generally upward direction moves the connecting links 232 generally downward, thereby pivoting latch arms 230 about the pivot pins 236. The latch arms 230 are pivoted out beyond the rear edge 228 and located behind a latch block on the rear side of a metal liner of the C-pillar 81 which is comparable to the metal liner 207 of the B-pillar 68. By maintaining the rear door 72 in the closed position, the blast forces are effectively transferred from the B-pillar 68 across the door 72 to the C-pillar 81 and into the rear structure 82 of the vehicle 20. Consequently, the protective system 28 transfers the blast forces from the front of the vehicle upwardly and rearwardly through the sides of the passenger compartment to structure at the rear of the vehicle, thereby minimizing deformation and damage to the sides of the passenger compartment and reducing the risk of injury to the occupants therein.

Figure 8:
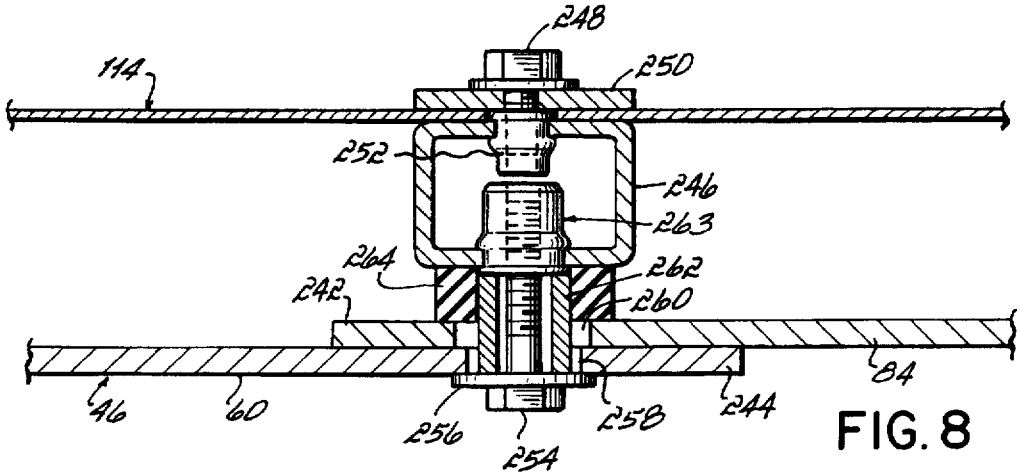
FIG. 8 is an enlarged cross-sectional view of the encircled section 8—8 of FIG. 1.

To further protect the passenger compartment, a rear underbody protective plate structure 84 is connected along its forward edge 242 to the rearward edge 244 of the front underbody plate structure 46 and to the vehicle body 114 as shown in FIG. 8. A structural aluminum tube 246 extends between the lateral edges of the structures 46, 84. The tube 246 is fastened to the vehicle structure 114 by means of a bolt 248 extending through a reinforcing washer plate 250 into a nut 252, for example, an upset nut, that extends through a top wall of the tube 246. A threaded fastener 254 extends through washer 256 through holes 258, 260 in the respective plate structures 46, 84 through a sleeve 262 and is threaded into a nut 263, also preferably an upset nut. A block of resilient material 264, for example, rubber, surrounds the sleeve 262 and extends between the lower wall of the tube 246 and the upper surface of the plate structure 84. Further, the holes 258, 260 in the respective plate structures 46, 84 are larger than the outer diameter of the sleeve 262. The above structure functions to resiliently connect the forward underbody structure 246 to the rear underbody plate structure 84. Consequently, during normal operation of the vehicle, the structures 46, 84 can independently move with respect to each other. Further, blast forces being carried by the forward underbody plate structure 46 will, to some extent, be absorbed by the resilient material 264 and by the energy required to move the forward underbody structure up against the forward side of the sleeve 262 and, in turn, move the rear side of the sleeve 262 against the forward edge of the hole 260 within the rear underbody plate structure 84. Therefore, the structure illustrated in FIG. 8 absorbs some of the blast forces and thereafter transfers the blast forces to the rear underbody structure of the vehicle. The rear underbody structure 84 is also connected to the structure of the vehicle in a manner as earlier described with respect to the front plate underbody structure 46.

The description of the system for the vehicle 20 has focused on a protective system 28 associated with the left side of the vehicle. The protective system 28 described with respect to the left side that includes the forward and rear underbody protective plate structures 46, 84, including the shield structure 44, the reinforcing plates 48, 50 and the A-pillar reinforcement 52, the abutments 62, 64, 74, 76 and latches 70, 80 and the front and rear doors 64, 72 that function to protect the passenger compartment 30 on the left side of the vehicle is preferably also applied to the right side of the vehicle. As will be appreciated, because of the different nature of components associated with the left and right hand sides, for example, the location of the battery, the location of fluid reservoirs and other electrical components mounted to the forward side of the engine compartment below the windshield, the specific geometry size and shape of the forward underbody plate structure 46 will have to be altered to accommodate those individual differences between the left and right sides of the vehicle. Similarly for the same reasons, the exact size and shape of the plates 48, 50 which are made for the right side of the vehicle will be slightly different in size and shape than those designed and manufactured for the left side of the vehicle. However, the function and operation of the forward system protecting the forward portion 32 on the left and right sides of the vehicle is identical. Given the detailed description with respect to the protective system 28 on the left side of the vehicle, it is believed that one who is skilled in the art can manufacture a functionally comparable protective system for the right side of the vehicle that will vary slightly in size and shape to accommodate the different physical structures on the right side of the vehicle. In addition, in the preferred embodiment, the front and rear doors and B and C pillars of the right side of the vehicle will be constructed identically as described and illustrated with respect to the left side of the vehicle to help transfer and distribute the blast forces along the right side of the passenger compartment 30 across the doors and to their respective pillars. Further, as will be appreciated, the various metal plates and pieces are preferably rigidly connected together by welding processes. The geometry of the weld is determined by engineering analysis, and welding standards and specifications are determined from published standards of the American Welding Society and from the military standards and specifications published in association with the specifications for the various materials selected. Those who are skilled in the art can use that information to determine various welding procedures and processes that satisfy both the desired weld geometry and the published welding standards and specifications.

In use, the protective system described herein may take several forms depending on how it is to be integrated into the vehicle structure. For example, the system 28 described herein may be part of a major retrofit of the HMMWV during which the system 28 and other armor or protective plates are added to the vehicle structure. It is preferable in the design of the system 28 to use originally manufactured parts to reduce the parts inventory. Further, the design should permit the system to be repaired in the field.

Alternatively, the major portion of the system 28 may be manufactured as a component of a kit that is applied to the vehicle in the field. In kit form, the system 28 would include the forward and rear underbody protective plate structures 46, 84 with the forward underbody structure 46, including the shield 44. The kit would also include the reinforcing plates 48 and 50 and the A-pillar reinforcement 52. One skilled in the art of vehicle armor design could readily adapt those components to make them suitable for use in a field installed kit based on the description of the components contained therein. For example, in kit form, it may be preferable that the reinforcing spacers 104, 106 of FIG. 3 be manufactured as part of the reinforcing plates 48, 50. Therefore, during installation, an appropriate portion of the walls 36, 38 of the forward portion 32 of the passenger compartment 30 is cut out and removed to permit the reinforcing plates 48, 50 containing the reinforcing spacers 104, 106 to be connected directly to the lateral edges of the shield structure 44.

While the invention has been set forth by a description of the preferred embodiment in considerable detail, it is not intended to restrict or in any way limit the claims to such detail. Additional advantages and modifications will readily appear to those Who are skilled in the art. For example, the described metallic materials used in the fabrication of the forward underbody plate structure and the reinforcing plates may be replaced by comparable metallic or other materials, for example, composite materials that provide the desired protection. Further, while the protective system has been described as being fabricated with a combination of welds and fasteners, other fabrication and connecting methods may be utilized.

In addition, while the preferred shield structure is that of a rigid beam, the shield structure can also fabricated so that the plurality of elements is only rigidly connected to one of the adjacent plates. Further, the plurality of reinforcing elements can take the form of tubes, U-shaped members or even solid shafts providing the desired mechanical function within the shield structure. The parallel arrangement of the reinforcing elements can be replaced by other arrangements, for example, a starburst arrangement, so that the desired function of the shield structure is obtained. Further, while various spacers are described as having a U-shaped configuration, such spacers could also be fabricated from tubing or comparable elements.

Provide further examples of alternative embodiments

The invention, therefore, in its broadest aspects, is not limited to the specific details shown and described. Consequently, departures may be made from the details described herein without departing from the spirit and scope of the claims which follow.

What is claimed is:

1. An apparatus for protecting a passenger compartment of a vehicle from a force of a blast, the passenger compartment having a forward portion in which the lower legs and feet of an occupant are positioned during use, the forward portion being located forward of a first pillar located adjacent a forward edge of a door, the apparatus comprising:

a protective plate structure shaped to cover areas of the forward portion of the passenger compartment, said protective plate structure being connected to the vehicle structure;

a pair of reinforcing plates, each of the reinforcing plates being located adjacent one of two opposing side walls of the forward portion of the passenger compartment and connected directly to said protective plate structure; and said protective plate structure including a shield to reinforce said plate structure at a location between an anticipated source of the blast and the lower legs and feet of the occupant, said shield absorbing a portion of the forces of the blast and transferring other forces of the blast through said protective plate structure and said reinforcing plates and around the forward portion of the passenger compartment to other structural members of the vehicle.

2. The apparatus of claim 1 wherein said shield is a beam structure.

3. The apparatus of claim 1 wherein said shield comprises:

a shield plate located adjacent a lower-forward section of said protective plate structure; and a plurality of reinforcing elements arranged in a spaced apart relationship between said shield plate and the lower-forward section of said protective plate structure and rigidly connected to one of said shield plate and said lower-forward section of said protective plate structure.

4. The apparatus of claim 3 wherein said plurality of reinforcing elements are rigidly connected to both of said shield plate and said lower-forward section of said protective plate structure.

5. The apparatus of claim 3 further comprising reinforcing spacers extending between said shield plate and the lower-forward wall section of the forward portion of the passenger compartment.

6. The apparatus of claim 3 further comprising reinforcing spacers extending between said shield plate and said reinforcing plates.

7. The apparatus of claim 3 wherein said plurality of reinforcing elements are arranged in a parallel relationship.

8. The apparatus of claim 3 wherein said plurality of reinforcing elements extend in a parallel relationship between lateral edges of said shield and outer plates.

9. The apparatus of claim 8 wherein each of said plurality of reinforcing elements is hollow.

10. The apparatus of claim 9 wherein each of said plurality of reinforcing elements has a rectangular cross-section.

11. An apparatus protecting a passenger compartment of a vehicle from forces of a blast, the passenger compartment having a forward portion formed by a lower-forward wall section with greater exposure to the blast, the apparatus comprising:

a shield located over the lower-forward wall section at a location between an anticipated source of the blast and the lower forward wall section;

a first reinforcing plate located adjacent an outer side wall of the forward portion of the passenger compartment and connected directly to an outer lateral edge of said shield; and a second reinforcing plate located adjacent an inner side wall of the forward portion of the passenger compartment and connected directly to an inner lateral edge of said shield, said shield absorbing through deformation a portion of the forces of the blast and transferring other forces of the blast through said reinforcing plates and other vehicle structure around the passenger compartment to minimize deformation of the forward portion in response to the blast.

12. The apparatus of claim 11 further comprising a first protective plate covering the outer side wall of the forward portion, said first reinforcing plate being connected to said first protective plate.

13. The apparatus of claim 12 wherein said first reinforcing plate is further connected to a pillar to which a door is hinged.

14. The apparatus of claim 13 wherein said first reinforcing plate is connected to said outer side wall and said first protective plate.

15. The apparatus of claim 11 wherein said second reinforcing plate is connected to vehicle structure.

16. The apparatus of claim 15 wherein said second reinforcing plate is connected to the inner side wall of the forward portion of the passenger compartment.

17. The apparatus of claim 11 further comprising:

a second protective plate connected to an upper edge of said shield and extending generally upwardly over a forward wall section of the forward portion; and a third protective plate connected to a lower edge of said shield and extending generally rearwardly over a floor section of the forward portion.

18. The apparatus of claim 17 wherein said third protective plate extends rearwardly from said shield and is connected to a lower structure of the vehicle.

19. The apparatus of claim 18 further comprising an interconnecting plate connected between said upper edge of said second protective plate and a first pillar located behind the forward portion of the passenger compartment.

20. An apparatus for protecting a passenger compartment of a vehicle from a force of a blast, the passenger compartment having a forward portion formed by a lower-forward wall section with greater exposure to the blast, the apparatus comprising:

a shield extending over the lower-forward wall section at a location between an anticipated source of the blast and the lower forward wall section;

a first reinforcing plate connected directly to an outer lateral edge of said shield and the vehicle;

a second reinforcing plate connected directly to an inner lateral edge of said shield and the vehicle;

a first protective plate connected between an upper edge of said shield and the vehicle; and a second protective plate connected between a lower edge of said shield and a lower structure of the vehicle, thereby absorbing some forces of the blast with said shield and transferring other forces of the blast through said reinforcing plates and said protective plates and around the forward portion of the passenger compartment of the vehicle.

21. The armor shield of claim 20 wherein said reinforcing plates are located on interior surfaces of the forward portion of the passenger compartment and said shield and said first and second protective plates are located on exterior surfaces of the forward portion of the passenger compartment of the vehicle.

22. An apparatus for protecting a passenger compartment of a vehicle from a force of a blast, the passenger compartment having a forward portion formed by a lower-forward wall section with greater exposure to the blast and forward, upper and lower wall sections and a first pillar, the apparatus comprising:

an underbody armor assembly connected to the vehicle, said underbody armor assembly including a shield extending in front of a lower-forward area of the forward portion of the passenger compartment at a location between an anticipated source of the blast and the lower forward wall section, a lower armor plate section connected to said shield and extending below a floor area of the forward portion of the passenger compartment, and a forward armor plate connected to said shield and extending in front of a forward area the forward portion of the passenger compartment;

a first reinforcing plate connected directly to an outer edge of said shield and the first pillar;

a second reinforcing plate connected directly to an inner edge of said shield and the vehicle; and an upper plate connected between an upper edge of said forward armor plate and the vehicle, thereby absorbing some forces of the blast with said shield and transferring other forces of the blast from said shield, through said reinforcing plates, said upper plate and said armor assembly around the forward portion of the passenger compartment of the vehicle.

23. The apparatus of claim 22 further comprising a pillar reinforcement connected to the first pillar.

24. An apparatus for protecting a passenger compartment of a vehicle from a force of a blast, the vehicle having a first pillar receiving the force of the blast from a forward portion of the vehicle, the apparatus comprising:

a door mounted at the first pillar to close over an outer body surface of the vehicle;

a first abutment mounted on and extending adjacent a forward edge of said door in juxtaposition with a rear edge of the first pillar;

a second abutment mounted on and extending adjacent a rear edge of said door in juxtaposition with a forward edge of a second pillar; and a manually pivotal latch having a first position permitting said door to move with respect to the second pillar and open, and a second position extending over an inner directed side of the second pillar to prevent said door from moving with respect to the second pillar in response to the force of the blast, said first abutment receiving forces of the blast when contacted by the rear edge the first pillar, said door transferring those forces to said second abutment, said second abutment contacting and transferring the forces of the blast to the forward edge of the second pillar.

25. The apparatus of claim 24 further comprising a shield extending in front of a lower-forward area of the forward portion of the passenger compartment.

26. The apparatus of claim 25 further comprising:

a first reinforcing plate connected between an outer lateral edge of said shield and the vehicle; and a second reinforcing plate connected between an inner lateral edge of said shield and the vehicle.

27. The apparatus of claim 26 further comprising:

a lower protective plate section connected to said shield and extending below a floor area of the forward portion of the passenger compartment; and a forward protective plate connected to said shield and extending in front of a forward area the forward portion of the passenger compartment.

28. The apparatus of claim 24 further comprising an upper plate connected between an upper edge of said forward protective plate and the vehicle.

29. The apparatus of claim 24 wherein said first abutment comprises first and second blocks connected to said door at different vertical locations.

30. The apparatus of claim 29 wherein said second abutment comprises a third block extending substantially over a length of said rearward edge of said door.

31. The apparatus of claim 30 wherein said latch comprises two spaced apart latch blocks pivotally connected to said door near said rearward edge of said door.

32. The apparatus of claim 24 wherein the vehicle has a second rear door mounted on a second pillar, the apparatus further comprises:

a first abutment mounted on and extending adjacent a forward edge of said rear door in juxtaposition with a rear edge of the second pillar;

a second abutment mounted on and extending adjacent a rear edge of said rear door in juxtaposition with a forward edge of a third pillar; and a second manually pivotal latch having an first position permitting said rear door to move with respect to the third pillar and open, and a second position extending over an inner directed side of the third pillar to prevent said rear door from moving with respect to the third pillar in response to the force of the blast, said first abutment receiving forces of the blast when contacted by the rear edge the second pillar, said rear door transferring those forces to said second abutment, said second abutment contacting and transferring the forces of the blast to the forward edge of the third pillar.

33. A method of protecting a passenger compartment of a vehicle from a force of a blast, the passenger compartment having a forward compartment for locating the lower legs and feet of an occupant, the forward portion being located ahead of a first pillar located adjacent a forward edge of a door, the method comprising the steps of:

fabricating an protective plate structure shaped to cover areas of the forward compartment;

fabricating a shield on the protective plate structure at a location directly between an anticipated source of the blast and the lower legs and feet of the occupant;

locating a reinforcing plate adjacent each of opposing side walls of the forward compartment;

connecting the reinforcing plates directly to the protective plate structure at spaced apart location corresponding to the opposing side walls; and connecting the protective plate structure and the reinforcing plates to the vehicle, the shield absorbing a portion of the forces of the blast and transferring other forces of the blast through the protective plate and reinforcing plates and around the forward compartment of the vehicle.

34. A method of protecting a passenger compartment of a vehicle from forces of a blast, the passenger compartment including a forward compartment having a lower-forward wall section with greater exposure to the blast and inner and outer side wall sections and a first pillar to which a door is hinged, the method comprising the steps of:

fabricating a shield adapted to be located over the lower-forward wall section at a location directly between an anticipated source of the blast and the lower forward wall section;

fabricating a first rigid structure comprised of a first reinforcing plate connected directly to the shield, the first rigid structure extending adjacent the outer side wall section between an outer edge of the shield and the first pillar; and fabricating a second rigid structure comprised of a second reinforcing plate connected directly to the shield, the second rigid structure extending adjacent the inner side wall section between an inner edge of the shield and vehicle structure, interconnecting the shield, the first and second rigid structures and the vehicle structure, the shield absorbing through deformation a portion of the forces of the blast and transferring other forces of the blast through the rigid structures around the passenger compartment to minimize deformation of the forward compartment in response to the blast.

35. The method of claim 34 further comprising the steps of:

fabricating a third rigid structure comprised of armor material connected to the shield, the third rigid structure extending between an upper edge of the shield and the first pillar; and fabricating a fourth rigid structure comprised of armor material connected to the shield, the fourth rigid structure extending between a lower edge of the shield and a lower structure of the vehicle.

36. A method of protecting a passenger compartment of a vehicle from a force of a blast, the passenger compartment having a forward portion formed by a lower-forward wall section with greater exposure to the blast and forward, upper and lower wall sections and a first pillar, the method comprising the steps of:

locating a shield over the lower-forward wall section at a location directly between an anticipated source of the blast and the lower forward wall section of the passenger compartment;

connecting a first reinforcing plate directly to an outer edge of the shield and the first pillar;

connecting a second reinforcing plate directly to an inner edge of the shield and the vehicle;

connecting a first armor plate between un upper edge of the shield and the vehicle; and connecting a second armor plate between a lower edge of the shield and a lower structure of the vehicle, thereby absorbing some forces of the blast with the shield and transferring other forces of the blast through the reinforcing plates and the armor plates around the forward portion of the passenger compartment of the vehicle.

37. A method of protecting a passenger compartment of a vehicle from a force of a blast, the passenger compartment having a forward portion for locating the lower legs and feet of an occupant, the forward portion being located ahead of a first pillar, the method comprising the steps of:

absorbing a first portion of the force of the blast with a shield located between an anticipated source of the blast and the lower legs and feet of the occupant;

transferring a second portion of the force of the blast from the shield to rigid structural elements connected directly to the shield and extending around opposing side walls and other boundary areas of the forward portion of the passenger compartment; and transferring the second portion of the force of the blast from the rigid structural elements to selected structural members of the vehicle bounding the passenger compartment and in mechanical communication with the rigid structural elements, thereby minimizing deformation of the forward portion of the passenger compartment and transferring blast forces away from the forward portion of the passenger compartment and to the selected structural members bounding the passenger compartment.

* * * * *

UNITED STATES PATENT AND TRADEMARK OFFICE

CERTIFICATE OF CORRECTION

PATENT NO. : 5,663,520

DATED : September 2, 1997

INVENTOR(S) : Michael D. Ladika, Dennis Jerome Malone, and David John Stevens

It is certified that error appears in the above-indentified patent and that said Letters Patent is hereby corrected as shown below:

In column 1, line 5, before "military", delete "a".
In column 5, lines 34, before "FIG.", delete "to".
In column 6, line 56, after "structure", insert --44.--.
In column 7, line 42, delete "to" and insert therefor --so--.
In column 8, line 42, delete "62" and insert therefor --52--.
In column 9, line 28, delete "remain" and insert therefor --remains--.
In column 11, line 41, before "fabricated", insert "be".

In the Claims:

In claim 32, column 15, lines 17 and 35, delete "an" and insert therefor --a--.

In claim 33, column 15, line 43, delete "location" and insert therefor --locations--.

Signed and Sealed this

Second Day of February, 1999

*Attest:*

*Acting Commissioner of Patents and Trademarks*

*Attesting Officer*